United States Patent [19]

Niedermeyer

[11] 4,228,427

[45] Oct. 14, 1980

[54] MONITOR APPARATUS FOR SUMP PUMPS

[76] Inventor: Karl O. Niedermeyer, 17W068 North St., Bensenville, Ill. 60106

[21] Appl. No.: 24,959

[22] Filed: Mar. 29, 1979

[51] Int. Cl.[2] ..... G08B 21/00

[52] U.S. Cl. ..... 340/623; 73/308; 73/311; 340/663

[58] Field of Search ..... 340/514, 605, 618, 620, 340/624, 623, 625, 663, 594; 73/313, 311, 308

[56] References Cited

U.S. PATENT DOCUMENTS

| | | | |
|---|---|---|---|
| 2,678,434 | 5/1954 | Brown et al. | 340/620 |
| 3,264,627 | 8/1966 | Austin | 340/594 X |
| 3,399,399 | 8/1968 | Apfelbaum | 340/620 X |
| 3,545,272 | 12/1970 | McGill | 340/623 X |

*Primary Examiner*—John W. Caldwell, Sr.
*Assistant Examiner*—Daniel Myer
*Attorney, Agent, or Firm*—Darbo & Vandenburgh

[57] ABSTRACT

Audible or visual warning signals are employed in a pump system having a primary and an auxiliary pump to indicate loss of power or a malfunctioning pump. Float switches react to a rising liquid level, thereby opening fail-safe circuits, and closing warning circuits which give sensory perceptible signals.

3 Claims, 2 Drawing Figures

52
36
66
76
84
80
78
96
94
ELECT. CONTROLS
69
71
70
70'
32
11
70
29
59
31
27
12
30
60
26
25
61
60'
17
13
60
19
28
20
10
22
24
14
18
23

MONITOR APPARATUS FOR SUMP PUMPS

BACKGROUND AND SUMMARY OF THE INVENTION

The present invention relates to a device for monitoring the operation of a plurality of liquid pumps operated from different power sources. In particular, there is disclosed a monitor apparatus for use with both primary and auxiliary pumps in a common sump, and particularly directed to power failure of the main power source or the auxiliary power supply and failure of one or both pumps.

Sump pumps become of particular importance in both commercial and residential use during heavy rain. Failure of electrical power is most likely to occur during this same period of time. An auxiliary pump employed to supplement such a primary pump is however most likely operated by an alternate power source such as a 12-volt battery. Such pump systems are arranged so that the auxiliary pump operates infrequently, only when the primary pump breaks down or when the intake is greater than the primary pump can handle. Although periodically charged by the main electrical power supply, the battery may become inoperative over time. Thus, it is a principal object of the present invention to warn of a failure in either or both of the power supplies.

Similarly, both the primary and auxiliary pumps themselves are subject to failure through various causes such as corrosion, fatigue and clogging from the liquid to be pumped. Another object of the invention is thus to warn of pump failure by monitoring the water level in the sump.

The present invention is intended to prevent property damage resulting from flooding water by giving advance notice so that preventive or corrective action may be taken.

DESCRIPTION OF SPECIFIC EMBODIMENT

Figure 1:
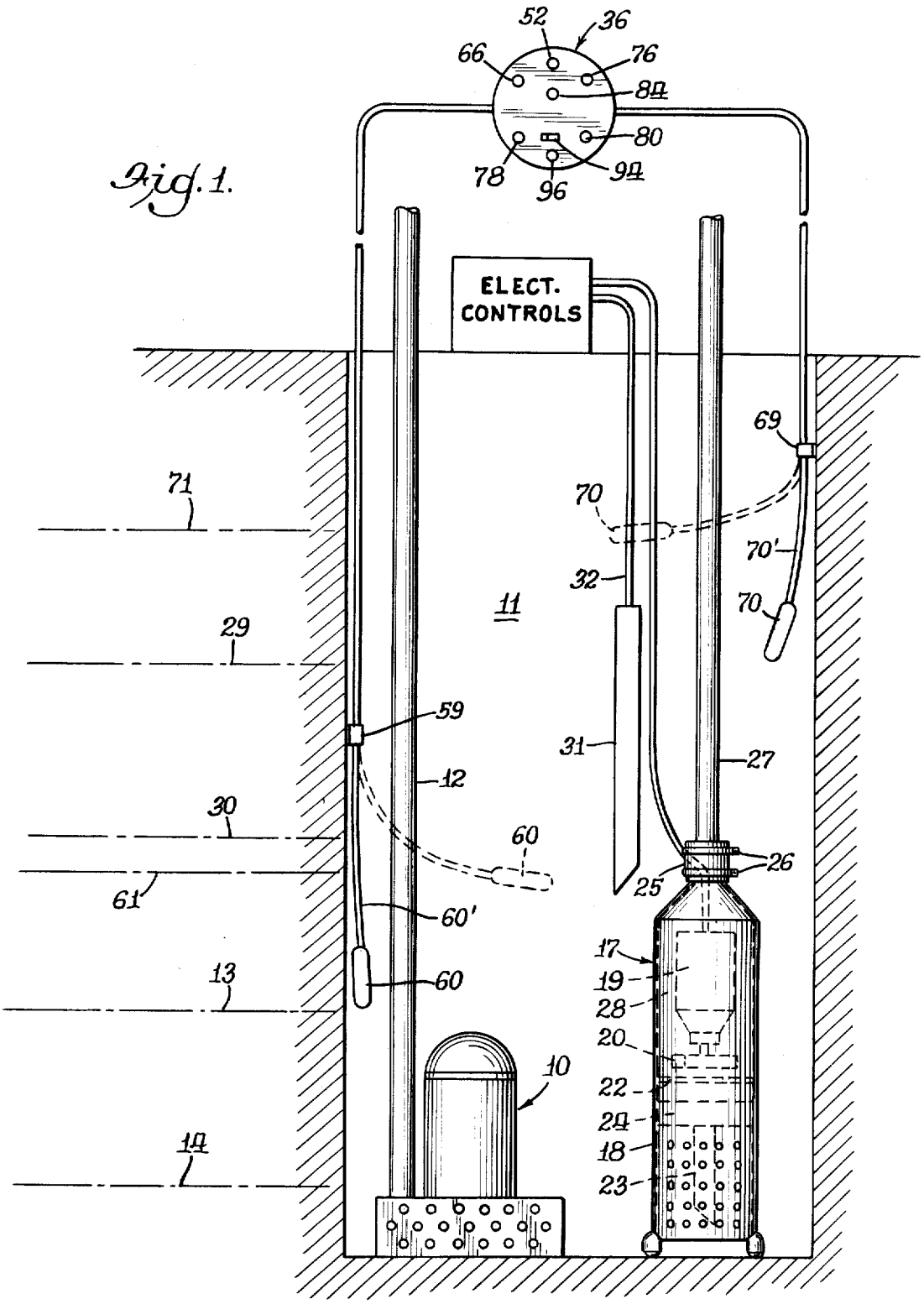
FIG. 1 is a side view of the primary and auxiliary pumps in a sump, together with the monitor apparatus, including float switches.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

A conventional sump pump, generally 10, (referred to herein as the primary pump) is employed in a sump 11 to remove liquid, e.g., water, which may collect therein. For example, the basements of homes or commercial establishments may have such sumps to collect water for removal and thereby keep the basement dry. A discharge pipe 12 is connected to this pump and extends to an appropriate location for discharge. Such a pump has controls (not shown) so that, for example, the pump is energized when the level of the liquid in the sump reaches that indicated by line 13 and the pump is turned off after it has extracted sufficient liquid from the sump to lower the liquid level to that of line 14.

Such primary pumps are subject to failure. For example, they are powered by the alternating current employed for electrical power elsewhere in the building. Thus, when a power failure occurs the pump becomes inoperative. Since it is not uncommon for such a power failure to occur as a result of a storm, the pump may become inoperative just at the very time it is needed most. Other factors that may result in the pump becoming inoperative are: corrosion of pump parts; and clogging of the pump, or pump screen, as a result of debris accumulating in the sump; etc.

As a result of the fact that the primary sump pump 10 may occasionally fail to operate, many users of sump pumps will also employ a secondary or backup sump pump unit, generally 17. The pump unit illustrated includes a housing or sheel 18 within which is a battery powered electric motor 19 whose shaft is connected to the impeller or pump 20. The intake for the pump is through a central opening in a plate 22, which opening communicates with a drawtube 23 held in an annular mount 24. The bottom of shell 18 is perforated to serve as a screen. The upper end of the shell is connected by means of a flexible hose 25 and hose clamps 26 to discharge conduit 27. The pump unit has a passageway 28 extending from the sump to the conduit 27, which passageway consists of the interior of the drawtube and the interior of the housing 18 about such interior parts as motor 19, etc. The arrangement is such that when the motor 19 is energized the pump 20 draws liquid out of the sump through passageway 28 and discharges it out through conduit 27. Further details of such a pump are illustrated and described in my pending application Ser. No. 793,402, filed May 3, 1977, and entitled Through Flow Sump Pump, the disclosure of which is incorporated herein by reference.

Such a secondary pump is not intended to operate all the time, but only in the event that the primary pump 10 fails to keep the liquid level in the sump down to the lower part thereof. Thus, for example, the controls for the secondary pump unit 17 will be set so that the pump unit will turn on when the liquid level in the sump reaches that indicated by line 29 and will turn the pump unit off when the liquid level drops to that indicated by line 30.

One such control of providing a differential in liquid level between the point at which the motor 19 turns on and turns off is described in my copending application Ser. No. 981,213, filed Mar. 29, 1978, and entitled Air Pressure Switch Signaling Two Different Pressure Conditions, the disclosure of which is incorporated herein by reference. It comprises a bell 31 which is suspended with its open end down and which communicates through a hose or tube 32 with a fluid pressure actuator 33 (FIG. 2) having a diaphragm 34 operatively connected to an electrical switch 35. As the water rises above the bottom, open end of the bell 31, air pressure builds up in the bell which pressure is transmitted through the hose to the actuator to move the diaphragm. At one air pressure condition (corresponding to level 29) switch 35 is closed, and at a second air pressure condition (corresponding to level 30) the switch 35 again is open. The same differential water level switch actuation can be achieved with float switches, as for example that described in my U.S. Pat. No. 4,806,457, issued Apr. 25, 1978, the disclosure of which is incorporated herein by reference.

The combination of the conventional sump pump 10 with the secondary pump 17, along with their respective power sources, forms an effective pump system.

Even with such a system, however, there may be problems resulting in flooding, such as failure of either or both pumps and/or their respective power sources, or an influx of liquid which is simply too great for even the pump system to handle properly. The present invention is a monitor apparatus, generally 36, connected to the pump system so as to warn of any of the above-mentioned dangers, thereby allowing time to make repairs or to evacuate items from the area being pumped. It is contemplated that the monitor apparatus (or particularly the sensory perceptible signal elements thereof) will be at a location at which they will be perceptible at frequent intervals by the persons occupying the building in which the sump is located. Such location might be the kitchen of a home or a guard station in a commercial building.

The monitor apparatus has two terminals 37 for connection to the primary power source 38. This primary source might be the usual domestic alternating current for lighting, etc. A step-down transformer 39 is employed to reduce the voltage to a level (e.g., 24-volts) at which special protective wiring precautions need not be taken. Primary wires 40 emanate from the terminals 37, said wires and terminals forming a means for supplying power to said monitor apparatus from the primary power source. Two end terminals 42 are provided so as to connect to the auxiliary power source 44. It is contemplated that this auxiliary power source would be the 12-volt direct current battery employed to operate the auxiliary pump unit 17. Auxiliary power wires 46 extend from the terminals 42, said wires 46 and terminals 42 forming a means for supplying power to the monitor apparatus from the auxiliary power source. Wires 46 form a closed circuit with a first inductor 48 forming a part of a first relay 49. Wires 40 are connected to and become part of the auxiliary power source failure circuit, generally 50. Within the auxiliary power source failure circuit are two auxiliary power source failure indicators emitting sensory perceptible signals. In the disclosed embodiment these indicators comprise red light 52 and horn 54. They are connected in parallel, with the two being connected between wires 40 through switch 56 of relay 49.

Connected between the wires 40 and parallel to the auxiliary power source failure circuit 50 is a first liquid level warning circuit, generally 58. Included in this warning circuit 58 is a first float switch 60 which is sensitive to the liquid level in the sump 11. Switch 60 is normally closed. It is positioned in the sump to be opened when the liquid level reaches that indicated by line 61, which is above the range of levels that occur during the normal operation of the primary pump 10. This positioning of the float switch is achieved by the clamping of the flexible support tube 60' by a bracket 59 secured to the wall of the sump. The first liquid level warning circuit 58 also includes a second relay comprising an inductor 62 and a switch 64. The switch arm of switch 64 is connected to one of wires 40 while the normally closed contact of the switch is connected to the other wire 40 through yellow light 66 which provides a sensory perceptible signal. The normally open contact of the switch is connected to one end of inductor 62. The other end of the inductor is connected to the upper wire 40 through float switch 60.

Also connected to the wires 40 and parallel to the auxiliary power source failure circuit 50 and first liquid level warning circuit 58 is the second liquid level warning circuit, generally 68. This warning circuit 68 includes a second float switch 70 which is normally in the closed position but which is responsive to and opens upon the liquid level reaching a predetermined level such as shown by line 71. This line 71 is chosen at a point higher than level 29 where the secondary pump 17 is normally activated. Again the flexible support for the float switch, in this case tube 70' for float switch 70, is held by a clamp, here 69, secured to the wall of the sump. By changing the location of the clamp and the amount of tube depending from the clamp to the float switch, the height that the water level must be to open the switch can be varied.

The second liquid level warning circuit 68 also includes a third relay comprising an inductor 72 and a switch 74. A blue light 76 is connected between the normally closed contact of switch 74 and one of wires 40, while the switch arm is connected to the other wire 40. One end of the inductor 72 is connected to the normally open contact of switch 74 and the other end is connected to said one of wires 40 through float switch 70.

Relays 64, 74 have manually operated reset buttons 78, 80 respectively. Connected between wires 40 and parallel to the auxiliary power source failure circuit 50 and first and second liquid warning circuits 58, 68 is the primary power source operation circuit 82 comprising white light 84.

In addition to the operation light 84, a second sensory perceptible warning means, in this case audible, is provided for failure of the primary power source. This includes a relay having its inductor 86 connected between wires 40. The audible signal is provided by a warning horn 90. Horn 90 is connected across the secondary power wires 46 through the normally closed contact of relay switch 92 and one contact of a manually operable switch 94. The other contact of switch 94 will connect a warning (e.g., red) light 96 across wires 46.

OPERATION

Figure 2:
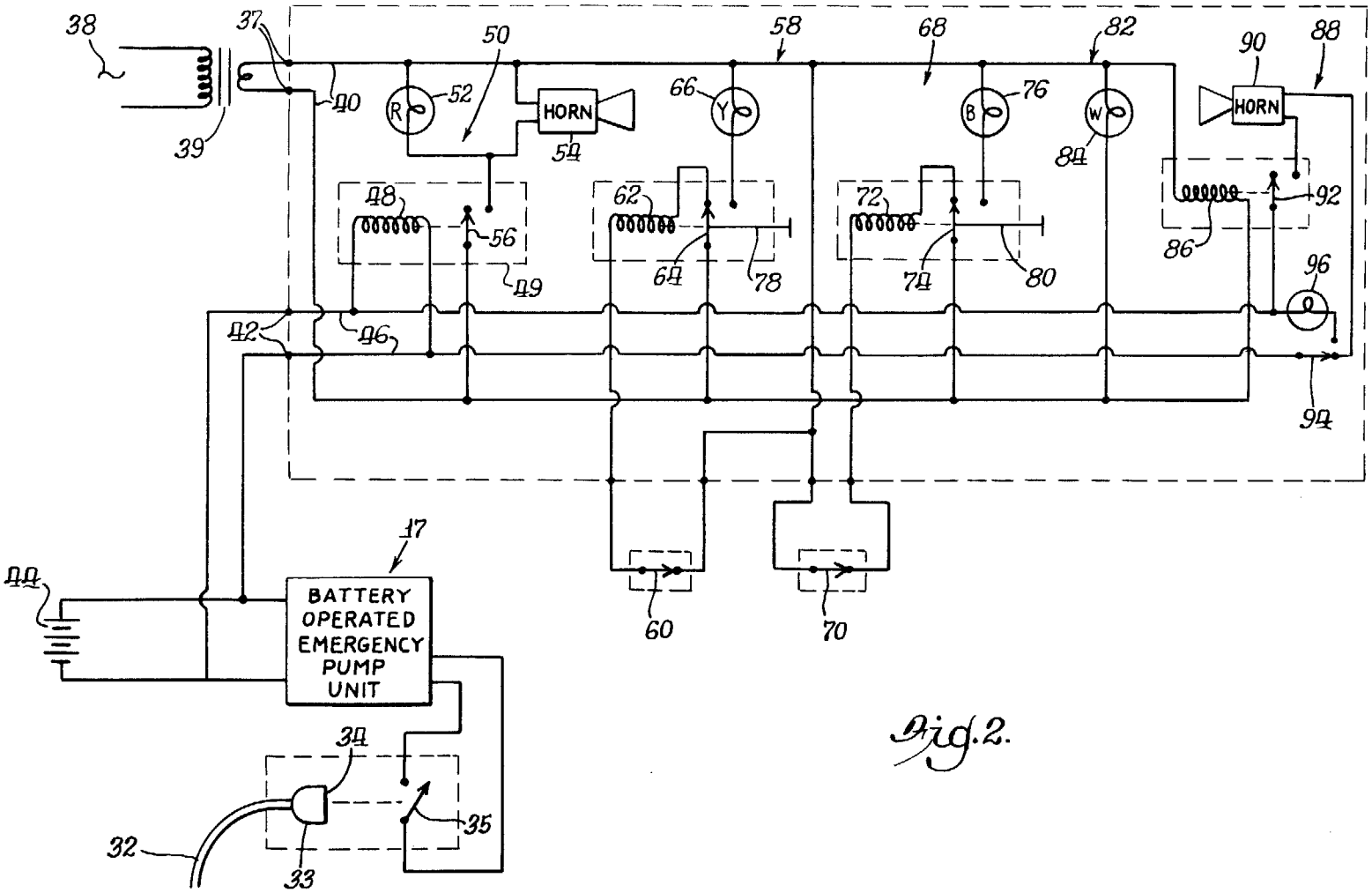
FIG. 2 is a circuit diagram of an embodiment of the invention.

FIG. 2, as drawn, illustrates the normal operating condition of the monitor apparatus, i.e., primary pump 10 is operating normally to keep the water level in the sump below that indicated by line 61. Both the primary and secondary power sources 38 and 44 are adequately supplying power. White light 84 is being illuminated signifying that the primary power is being received. The inductors of all of the relays are energized. Thus, all of lights 52, 66, 76 are dark and both of horns 54 and 90 are silent. Switch 94 is in the position illustrated and the fact that light 96 is dark signifies that the horn 90 is connected to be activated should a failure occur in the primary power source 38.

One of the problems that can occur to cause a malfunction of the sump pump arrangement, and which is to be guarded against, is a failure of one or the other of the power sources. Assume that the primary power source 38 fails. White light 84 will go dark, providing a sensory perceptible signal. Also, a signal will be provided by horn 90 due to inductor 86 of the fourth relay becoming deenergized. When this inductor is deenergized, the switch arm of switch 92 moves to the normally closed contact. This connects horn 90 across the secondary power wires 46. This, of course, will alert any person within range of the sensory perceptible signal provided thereby. If that person is disturbed by the continued sounding of the horn, the horn may be silenced by operating switch 94. When this is done light 96 goes on to provide an indication that the horn no longer is capable of providing a sensory perceptible signal.

Assume that instead of the primary power source 38 failing, it is the secondary power source 44 that fails. This will deenergize the secondary power wires 46 with the result that inductor 48 of the first relay is deenergized. The deenergizing of this inductor allows the switch arm of switch 56 to return to its normally closed contact. Thereupon, both the red light 52 and the horn 54 are connected across the primary power wires 40. The sensory perceptible signals thereby provided will alert those persons available of the fact of a power failure.

With lead-acid batteries used for the secondary power source 44, as is usually the case, it frequently happens that the battery terminal connections become corroded. This can result in a poor electrical connection to an extent such that power is not being delivered from the battery, although the battery is fully charged. Of course, when such a condition occurs the auxiliary power source failure circuit 50 will provide a sensory signal. Being thus alerted, an attendant will inspect for the cause of the electrical failure and take the required corrective action.

After the occurrence of either of the above power failures and the subsequent correction of the condition that caused the failure, the sensory perceptible indication of the failure will cease. That is, when the primary power source 38 again comes on light 84 will be illuminated and inductor 86 will be energized. If the position of switch 94 has been changed during the failure, light 96 will remain on signifying that switch 94 should be set back to its original position. In the instance in which it was the secondary power source 44 that failed, the reestablishment of that power source will energize inductor 48 moving the switch arm of switch 56 back to the position illustrated. Thus, light 52 will go out and horn 54 will be silent.

Assume that there is a failure of the primary pump 10, or such an influx of water into the sump that this pump is incapable of keeping up with the influx. When the water level in the sump rises to that indicated by line 61, float switch 60 moves to the position illustrated in dotted lines. Thereupon this normally closed switch opens. This results in the deenergizing of inductor 62 of the second relay, whereupon the switch arm of switch 64 moves to its normally closed contact. Thus this switch completes a circuit between the primary power wires 40 and through the yellow light 66. This advises a person viewing the monitoring panel that there has been such an increase in the water level in the sump. The indication provided by yellow light 66 will remain even though the water level thereafter drops below that indicated by line 61. It is true that upon the water level thereafter dropping below line 61 the switch 60 will again close, but this will not energize inductor 62. The switch arm of switch 64 will remain on its normally closed contact, energizing yellow light 66. This continues to advise the person viewing the panel that a check should be made in the sump, as for example to make sure that the primary pump 10 is operating. It may have been that the primary pump 10 failed, but that by reason of the operation of the secondary pump 17, by reason of seepage, etc., the water level again dropped below the level 61. After the sump has been checked and the person is satisfied that everything is in proper operating condition, the person presses on the manual reset button 78. This moves the switch arm of switch 64 back to the position illustrated in FIG. 2, whereupon inductor 62 is reenergized and yellow light 66 is turned off.

Now assume, that both the primary and secondary pumps fail, or by reason of excessive influx of water, the water level in the sump rises to the level indicated by line 71. At that time, both of the float switches 60 and 70 will be open. The opening of switch 60 will result in the illumination of yellow light 66 in the manner heretofore described. Similarly, the opening of switch 70 will deenergize solenoid 72 of the third relay whereupon the switch arm of switch 74 will move to the normally closed contact and connect blue light 76 across the primary power wires 40. When a person then views the monitoring panel, the fact that both of these lights are illuminated will suggest that a further corrective study must be made in the sump to make sure that both of the pumps 10 and 17 are in an operating condition, not plugged up, etc. After such an inspection is made, any necessary corrective action is taken, and the water level again brought down to the lower part of the sump, the reset buttons 78 and 80 are both pressed to return the second and third relays to the energized condition, as illustrated.

A failure of the primary power source 38 also will result in the lighting of the two lights 66 and 76, due to the fact that the relay inductors 62 and 72 become deenergized. If such failure is only temporary and a person is not present to take note of the occurrence until after power has been restored, it then will be found that light 84 has again turned on and horn 90 is silent as a result of the reestablishment of power, but lights 66 and 76 remain illuminated. After a check of the sump conditions and the pumps reveal no excessive water conditions or malfunctions of the pumps, one will be apprised of the temporary power failure occurrence. Of course, push buttons 78, 80 would then be pressed to return the respective relay switches to the illustrated condition.

It is readily apparent that some of the sensory perceptible signaling devices of the described embodiment are redundant, in the sense that both visible and audible signals are provided to indicate the same undesirable condition. In some instances it may be sufficient to provide only one of these duplicative signals. However, it is particularly important that both (52 and 54) be used to indicate a failure of the battery 44 forming the secondary power source. In the event of that failure, it is very important that corrective action be taken as promptly as possible since it may take some time, in that event, to check the condition of the battery, acquire another battery, and install the replacement battery. It is less important that the signaling devices 84 and 90 be duplicative since a failure in the primary power source 38 usually is within the control of the public utility which will take the necessary corrective action as expeditiously as possible. In that event there is little that the householder can do. However, sometimes the failure is on the premises being protected, as for example by reason of a blown fuse. This might be on a circuit having no other significant electrical devices. It is for this reason that at least one, if not both, the sensory perceptible signals provided by light 84 and horn 90 are important.

Merely for simplicity of illustration and description, the described embodiment employs float switches 60 and 70 held by brackets 59 and 69 as a means of detecting certain water level conditions in the sump. Generally it would be found to be inconvenient to affix brackets to the walls of the sump because of space limitations. Affixing the brackets to a supplemental support which could then be put into the sump would be more simple. Actually, I prefer to use an air pressure control such as that described in connection with components 31–35 of the foregoing description as a liquid level sensing device. To replace the two float switches, two of the bells such as 31 (connected to respective pressure activated switches, such as 35) would be suspended in the sump at elevations such as to produce switch actuations at the water levels 61 and 71 respectively. Normally, I would releasably affix two such bells to each other and to a common suspension lowered into the sump. It will also be apparent to the workers in the art that there are solid state switching devices which are the full electrical equivalent of mechanical relays. The term "relay" as used herein is employed to encompass such solid state switching devices.

I claim:

1. In a monitor apparatus for a pump system for a sump or the like, which system includes a primary pump operated from a primary electrical power source, a secondary pump operated by an auxiliary electrical power source, and control means for energizing the primary pump from its source when the liquid level in the sump reaches a first, relatively low, elevation and for energizing the secondary pump from its source when the liquid level in the sump reaches a second, relatively high elevation, the improvement comprising:

first means for connecting said monitor apparatus to said primary power source to supply electrical power to said monitor apparatus from said primary power source;

second means for connecting said monitor apparatus to said auxiliary power source to supply electrical power to said monitor apparatus from said auxiliary power source;

relay means comprising a normally closed switch and connections at which when power is applied thereto will cause said switch to open;

means connecting said relay connections to said second means whereby said switch is open so long as said auxiliary power source is supplying electrical power to the monitor apparatus;

an auxiliary power source failure indicator producing, when energized, a sensory perceptible signal;

circuit means connecting said first means, said switch and said indicator for energizing said indicator from said primary power source when said switch is closed;

water level sensor means having a portion in the sump for detecting when the liquid level therein rises to a given elevation which is higher than said first elevation, said sensor means including a normally closed sensor switch which is opened when the liquid level rises to said given elevation;

a liquid level warning indicator producing, when energized, a sensory perceptible signal;

a second relay means comprising a second normally closed switch, switch holding means manually actuatable to an active condition, and connections at which when power is applied thereto and said holding means is in said active condition will cause said second switch to open and remain open so long as said switch holding means remains in said active condition, said holding means returning to an inactive condition when power ceases to be supplied to said connections of the second relay means;

circuit means connecting said first means, said indicator and said second switch in series whereby said indicator is energized when said second switch is closed; and circuit means connecting the connections of the second relay means, the sensor switch and the first means in series to apply electrical power to the connections of the second relay means so long as the sensor switch is closed.

2. In a monitor apparatus as set forth in claim 1, the further improvement comprising second water level sensor means having a portion in the sump for detecting when the liquid level therein rises to a specified elevation which is higher than said second elevation, said second sensor means including a second normally closed sensor switch which is opened when the liquid level rises to said specified elevation;

a second liquid level warning indicator producing, when energized, a sensory perceptible signal;

a third relay means comprising a third normally closed switch, second switch holding means manually actuatable to an active condition, and connections at which when power is applied thereto and said second holding means is in said active condition will cause said third switch to open and remain open so long as said second switch holding means remains in said active condition, said second holding means returning to an inactive condition when power ceases to be supplied to said connections of the third relay means;

circuit means connecting said first means, said second indicator and said third switch in series whereby said second indicator is energized when said third switch is closed; and circuit means connecting the connections of the third relay means, the second sensor switch and the first means in series to apply electrical power to the connections of the third relay means so long as the second sensor switch is closed.

3. In a monitor apparatus for a pump system for a sump or the like, and for use with an electric power source, which system includes a pump and control means for energizing said pump when the liquid level in the sump reaches a first elevation, the improvement comprising:

first means for connecting said monitor apparatus to said power source to supply electrical power to said monitor apparatus;

water level sensor means having a portion in the sump for detecting when the liquid level therein rises to a given elevation which is higher than said first elevation, said sensor means including a normally closed sensor switch which is opened when the liquid level rises to said given elevation;

a liquid level warning indicator producing, when energized, a sensory perceptible signal;

relay means comprising a normally closed switch holding means manually actuatable to an active condition, and connections at which when power is applied thereto and said holding means is in said active condition will cause said switch to open and remain open so long as said switch holding means remains in said active condition, said holding means returning to the inactive condition when power ceases to be supplied to said connections;

circuit means connecting said first means, said indicator and said switch in series whereby said indicator is energized when said switch is closed; and circuit means connecting the connections of the relay means, the sensor switch and the first means in series to apply electrical power to the connections of the relay means so long as the sensor switch is closed.

* * * * *